US005823247A

United States Patent [19]

Weibler

[11] Patent Number: 5,823,247

[45] Date of Patent: Oct. 20, 1998

[54] HEAT EXCHANGER AND METHOD

[76] Inventor: Walter W. Weibler, 7652 Webster Way, Arvada, Colo. 80003

[21] Appl. No.: 689,708

[22] Filed: Aug. 16, 1996

[51] Int. Cl.[6] ..... F28D 9/02

[52] U.S. Cl. ..... 165/76; 165/166; 165/DIG. 384; 228/183

[58] Field of Search ..... 165/165, 166, 165/76; 228/183

[56] References Cited

U.S. PATENT DOCUMENTS

| | | | |
|---|---|---|---|
| 1,548,159 | 8/1925 | Murray | 165/166 |
| 2,596,008 | 5/1952 | Collins | 165/166 X |
| 2,959,400 | 11/1960 | Simpelaar . | |
| 3,229,763 | 1/1966 | Rosenblad | 165/166 |
| 4,569,391 | 2/1986 | Hulswitt et al. | 165/166 |
| 4,688,631 | 8/1987 | Peze et al. | 165/166 |
| 5,069,276 | 12/1991 | Seidel | 165/166 |
| 5,303,771 | 4/1994 | Des Champs | 165/165 |
| 5,469,914 | 11/1995 | Davison et al. . | |

FOREIGN PATENT DOCUMENTS

| | | | |
|---|---|---|---|
| 1183834 | of 0000 | Canada . | |
| 0040890 | of 0000 | European Pat. Off. . | |
| 1389833 | 1/1965 | France | 165/166 |

*Primary Examiner*—Allen Flanigan
*Attorney, Agent, or Firm*—Ancel W. Lewis, Jr.

[57] ABSTRACT

A heat exchanger device and method of making same disclosed has a heat exchanger core and a stack of inner plates with alternating hot and cold flow fluid passages producing diagonal flow therethrough. One embodiment adds a pair of core retaining plates with end portions extending beyond the core with apertures at precise locations to connect with connectors of equipment to which it is coupled and the other embodiment has end connectors that weld to the core to provide straight in line fluid flow.

12 Claims, 5 Drawing Sheets

HEAT EXCHANGER AND METHOD

TECHNICAL FIELD

This invention relates to heat exchangers and more particularly to flat plate heat exchangers and a method of making same.

BACKGROUND ART

Heat exchangers have a wide range of heating and cooling applications wherever heat transfer between two fluids is required. In general in a heat exchanger two fluids, one hot and the other cold, are passed through alternate passages for heat transfer to the two fluids.

Simpelaar No. 2,959,400 discloses a flat plate heat exchanger wherein layers of rectangular sheets are connected at their edges and corner pieces for support and hot and cold fluids are caused to flow in opposite directions and provide an interchange of energy between the two.

Carlson Canadian Patent No. 1,183,834 discloses a flat plate heat exchanger chiefly characterized by flat plates separated by spacers and having inlets and outlets in opposite sides of the heat exchange elements.

Konings European Patent No. 0,040,890 discloses a flat plate heat exchanger with internal baffles establishing a zig zag flow pattern.

Davison et al. No. 5,469,914 discloses a flat plate heat exchangers having stacks of plates with spaces between the plates and forms a V-shape at each end and the two outside plates are made integral with the core.

DISCLOSURE OF THE INVENTION

The heat exchanger device and method has a heat exchanger core having a first plate and a second plate and a stack of parallel spaced inner plates between the first and second plates with spaces between the inner plates defining passages for the flow of hot and cold fluids for heat transfer between the two fluids. The core is made separately and tested for leaks and then a first core retaining plate is affixed to one face of the core and a second core retaining plate is affixed to an opposite face of the core and end wall portions are provided at the opposite ends of the core for forming flow compartments into which fluids may be conducted toward and away from the heat exchanger core. Each of the first and second core retaining plates have a pair of flow apertures at preselected precise locations in relation to flow line connections to which the device is connected for fluid flow. Each pair of flow apertures are in opposite end portions of the core retaining plates beyond the ends of the core.

BRIEF DESCRIPTION OF THE DRAWINGS

Details of this invention are described in connection with the accompanying drawings which like parts bear similar reference numerals in which.

DETAILED DESCRIPTION

Figure 1:
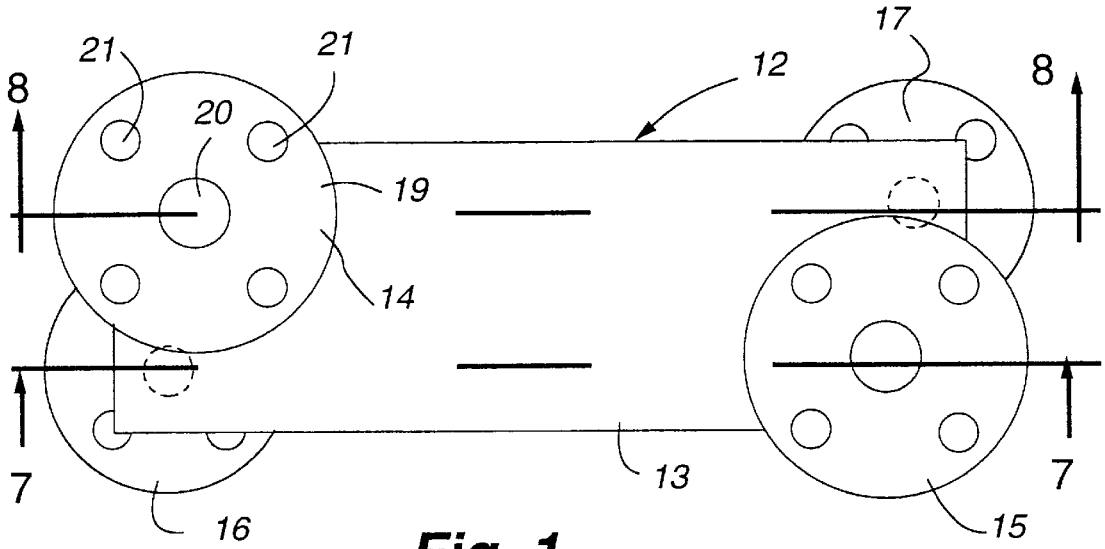
FIG. 1 is a top plan view of the heat exchanger device embodying features of the present invention.
Figure 2:
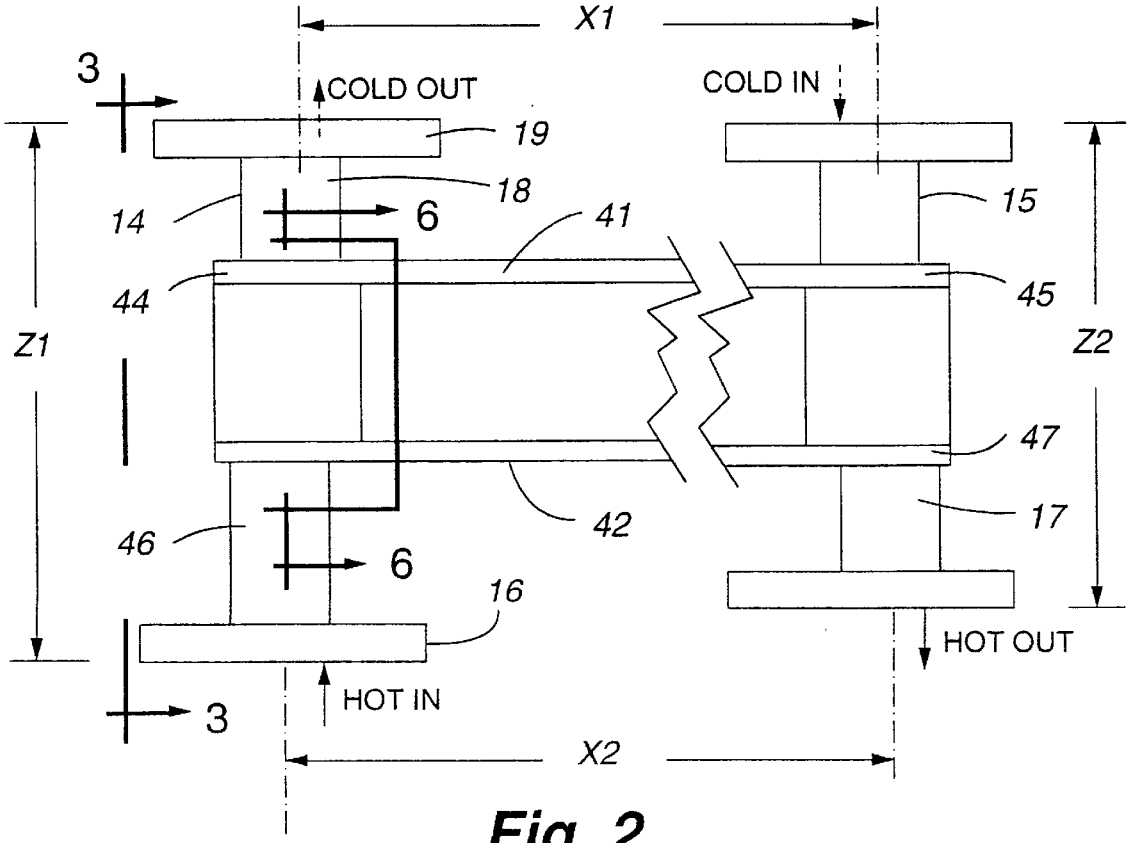
FIG. 2 is a side elevation view of the heat exchanger device.
Figure 3:
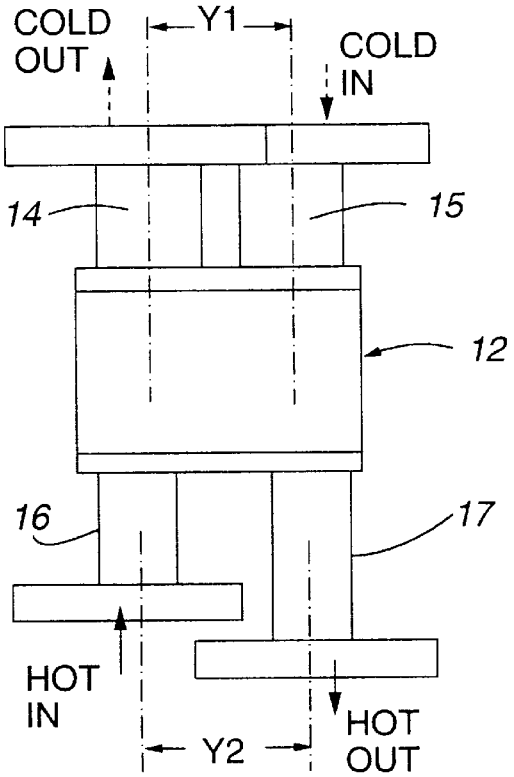
FIG. 3 is an end elevation view of the heat exchanger device.
Figure 4:
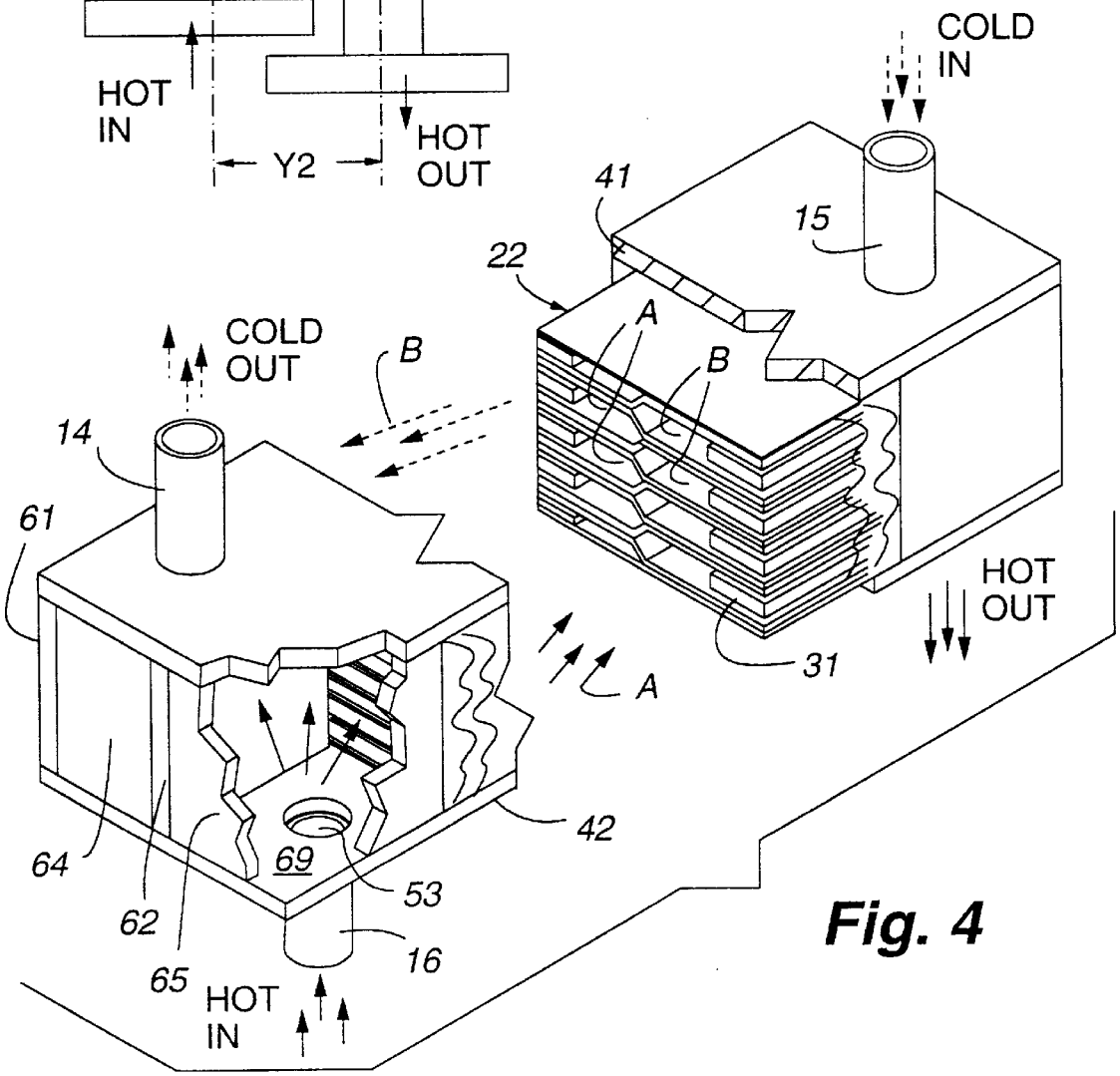
FIG. 4 is an exploded view partially broken away of the heat exchanger device.
Figure 5:
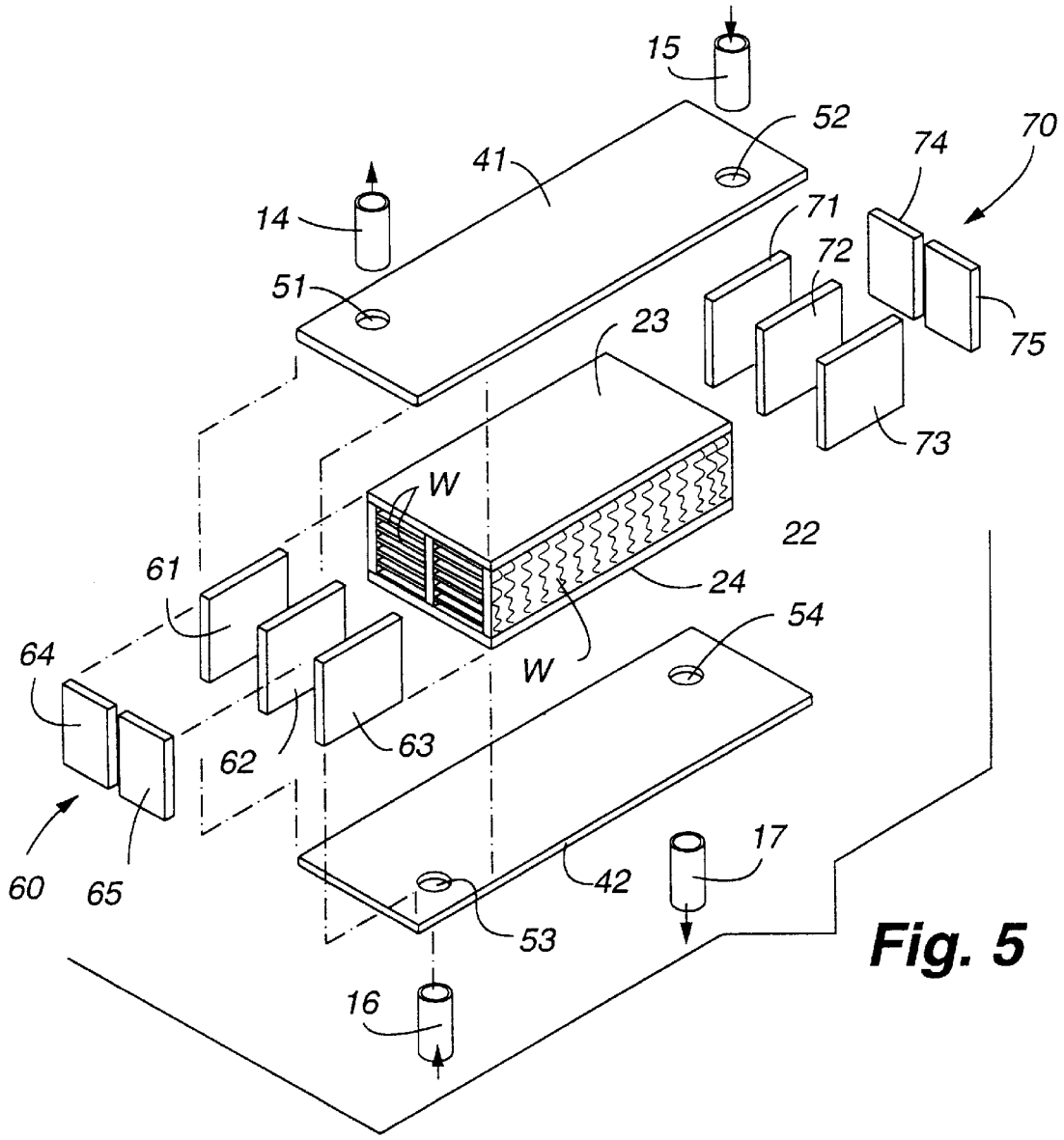
FIG. 5 is an exploded view of the heat exchanger shown in FIGS. 1–4 prior to assembly and welding.

Referring now to the drawings there is shown a heat exchanger device 12 having an oblong housing of body 13, two flow connectors 14 and 15 on one face herein shown as the top of the body and two flow connectors 16 and 17 on the bottom of the other face herein shown as the body 13. Each flow connector shown and with reference to connector 14 has a tubular portion 18 and a circular flange portion 19 with a center hole 20 and with four circumferentially spaced holes 21 in the flange portion 19 for mounting purposes.

There is a preselected fixed longitudinal distance between the center lines of connectors 14 and 15 designated X1 and a preselected lateral distance designated Y1 and a preselected fixed longitudinal distance between the center line of connectors 16 and 17 designated X2 and a preselected lateral distance designated Y2. There is a preselected fixed distance between the center lines may be precisely located using the attachable core retaining plates described hereafter.

The length of the connectors 14, 15, 16 and 17 along the center lines may also vary to meet preselected mounting requirements. The length between the ends of connectors 14 and 16 is designated Z1 and the length between the ends of connectors 15 and 17 is designated Z2. The end-to-end dimensions of the connectors 14 and 16 and between 15 and 17 according to the present invention may be readily varied to meet any installation requirements.

Figure 6A:
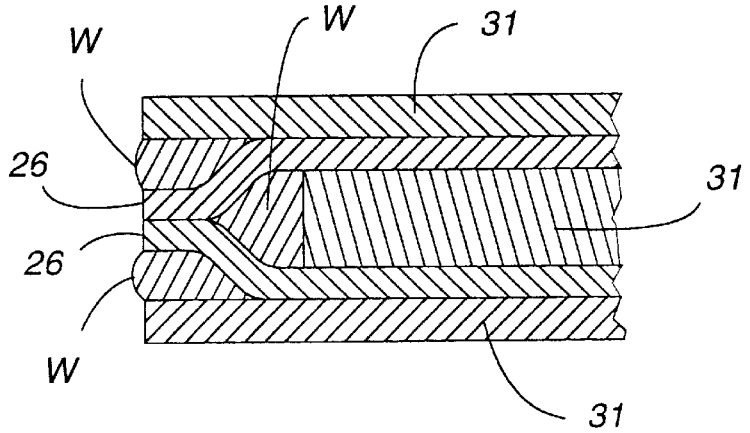
FIG. 6A is a sectional view along line 6A—6A showing a detail showing the weld of step 2 of the welding procedure.
Figure 6:
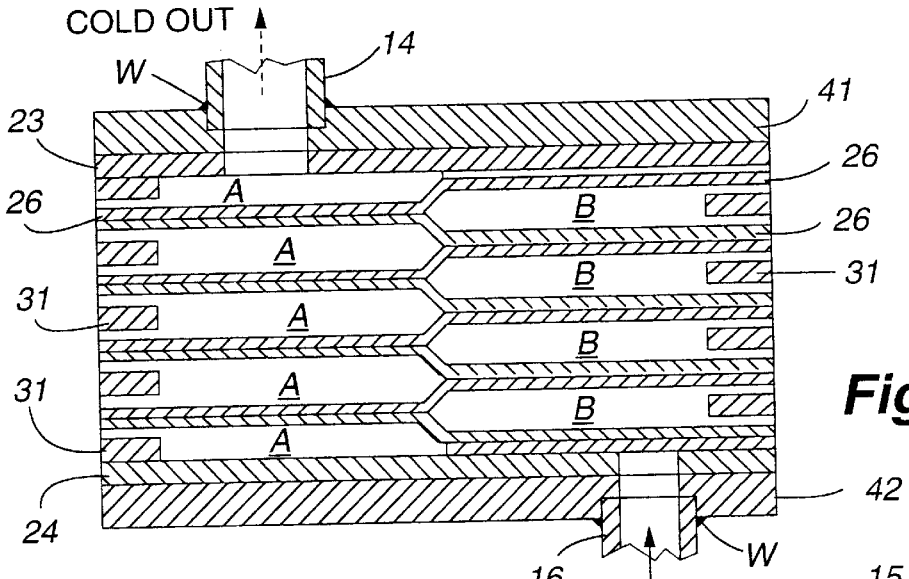
FIG. 6 is a sectional view taken along lines 6—6 of FIG. 2.
Figure 7:
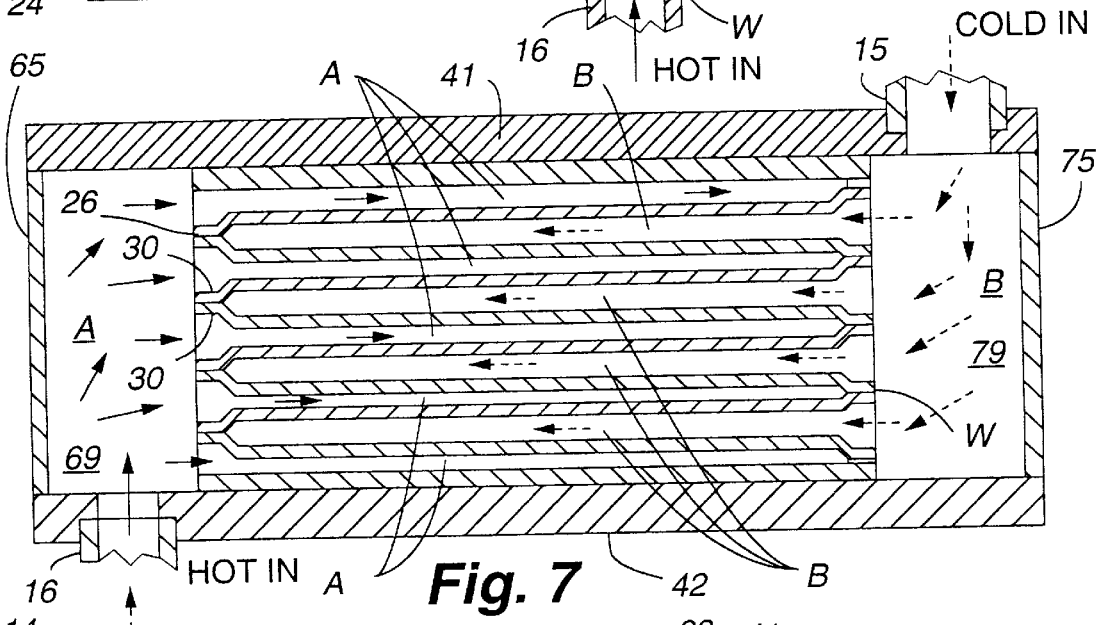
FIG. 7 is a sectional view taken along line 7—7 of FIG. 2.
Figure 8:
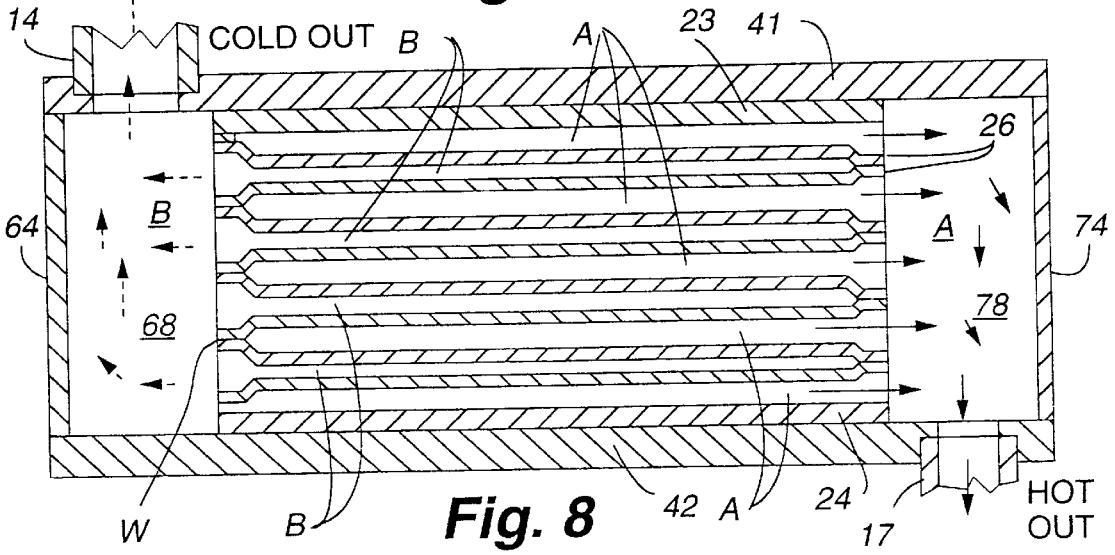
FIG. 8 is a sectional view taken along line 8—8 of FIG. 2.

The body 13 includes a heat exchanger core 22 having a first plate 23 shown at the top, second plate 24 shown at the bottom with a stack of parallel spaced inner plates 26 between the first and second plates with spaces between the inner plates defining alternate flow passages for hot and cold fluids. As shown in FIG. 6 the outer core plates 23 and 24 are thicker than the inner core plates 23 and 24. The inner core plates 23 and 24 are thin to effect good heat transfer. The outer core plates are constructed to resist pressure. In particular the outer core plates 23 and 24 are of a thickness or material having a greater ability to resist pressure than the inner core plates 23 and 24 so the core is able to withstand the pressure of leak testing. The hot flow passage is designated A and the cold flow passage is designated B with a solid arrow showing hot fluid and the dashed arrow showing cold fluid.

Figure 9:
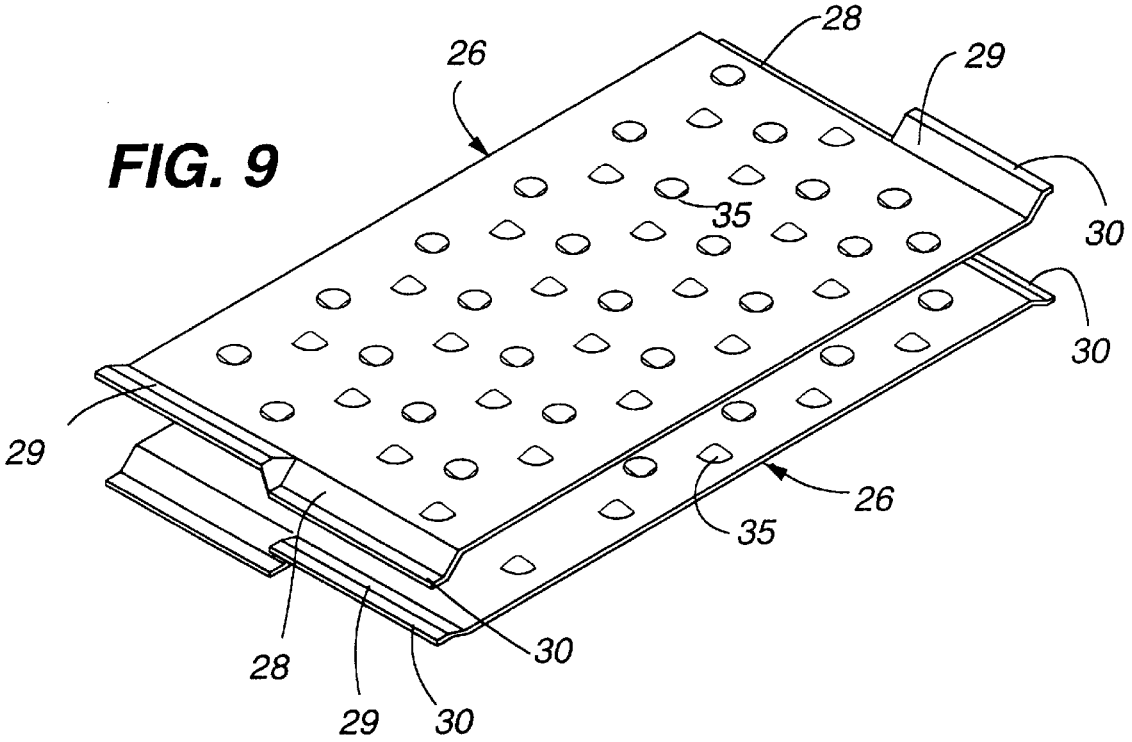
FIG. 9 is a perspective view of two of the flat inner plates before assembly.

Referring now to FIG. 9 the inner plates 26 and 27 of core are shown to have a downwardly inclined end section 28 along half the width and an upwardly inclined section 29 along the other half the width at one end of the plate. There is an upwardly inclined end section 29 along half the width and a downwardly inclined end section 28 along the other half of the width at the other end. Each inclined end section has a straight end section 30 parallel to the plane of the plate. Inner plate 27 has an upwardly inclined end section 29 opposite each downwardly inclined section 28 on inner plate 26 and a downwardly inclined end section 28 opposite each upwardly inclined section 29 on inner plate 26 so that the downwardly inclined end section 28 of the upper inner plate 27 fits against an upwardly inclined end section 29 of the lower inner plate 26 along one half the plate and the upwardly inclined section 29 of the upper inner plate 27 and a downwardly inclined end section 28 on the other half at one end flare away. This is reversed at the other end so the flow is diagonally across the plates. A longitudinal edge spacer 31 extends along both edges between the plates to separate the plates. Inner plates 26 and 27 alternate in core 22 so that the diverging end sections and converging end sections alternate from the top to the bottom of the core. As seen in FIG. 6A the longitudinal spacer between the diverging end sections extends further than the longitudinal spacer between the converging end sections. The diverging end sections are welded along the abutting flat end surfaces 30. The plate 26 has indentations or dimples 35 in a preselected pattern which provide strength and maintain spacing between plates.

In accordance with the present invention the core is made first, tested for leaks and then first and second core retaining plates 41 and 42 are secured to opposite faces of the core, respectively herein shown as the top and bottom of the core. The first core retaining plate 31 has opposed first end portions 44 and 45 that extend beyond the ends of the core and similarly the second plate 42 has opposed second end portions 46 and 47 that extend beyond the ends of the core. The first plate 41 has a pair of opposed apertures 51 and 52 and end portions 44 and 45, respectively, that are precisely located in relation to the flow line connections to which the device is connected. The second plate 42 has a pair of opposed apertures 53 and 54 in the end portions 46 and 47, respectively, that are also precisely located in relation to flow line connectors to which the device is connected.

A first end wall portion 60 at one end of the core 22 includes three spaced longitudinally extending divider plates 61, 62 and 63 and two end plates 64 and 65 secured at one end of the core 22 between the end portions of the first and second core retaining plates to form first flow compartment 68 in flow communication with opening 51 and a second flow compartment 69 in flow communication with opening 53. A second end wall portion 70 identical to end wall portion 60 includes three spaced, longitudinally extending divider plates 71, 72 and 73 and two end plates 74 and 75 to form a third flow compartment 78 in flow communication with opening 54 and a fourth flow compartment 79 in flow communication with opening 52.

The core 22 is frequently made of an exotic material such as titanium. The above construction allows the core to be tested for leaks before final weldments to the core retaining plates and allows for repair should a leak be detected. The use of separate plates for strengthening of the core also allows the flow apertures to be at precise positions in relation to the equipment to which they are attached. Frequently, the equipment to which they are attached such as pumps or molds is a very close fitting arrangement and precise close tolerances are required to attach the exchanger to associated equipment.

According to the method of the present invention in making core 22 the first step is to weld the end joints of each inner plate at the edges of the inclined sections at both ends of the plates. Several of the weld joints are indicated by the letter W. The second step has the welding of the side corner joints between the inner plates and spacers closed as shown in FIG. 6A. Preferably a filler wire is used. The third step involves closing the end joint corners and filler wire is used. Step four involves welding the center of the end joint weld which separates the fluid cavities with a filler wire weld. The fifth step involves the welding of the edge spacer and inner plate joints. At the end of the fifth step the heat exchanger core 22 is completed and is tested for leaks between fluid cavities as well as any external leaks.

In the sixth step the fluid connectors 14–17 are welded to the outside of the core retaining plates 41 and 42. The seventh step involves having the heat exchanger core located on the bottom outside retaining plate and equal distance from the end and welding the plate across the width of the plate with a filler wire using a fillet weld. The eighth step involves welding the center divider plates 62 and 72 to the heat exchanger core and to the outside core retaining plate. In step nine the top outside core retaining plate is welded to the heat exchanger core 22 across the width and at the joint created with the center plate. Step ten involves welding the side plates 61, 63, 71 and 73 to the core and to the top and bottom of the retaining plates. In step eleven the end plates 64, 65, 74 and 75 are welded to the top and bottom core retaining plates 41 and 42 and the center plates 62 and 72. The device is then complete and again tested for leaks.

Figure 10:
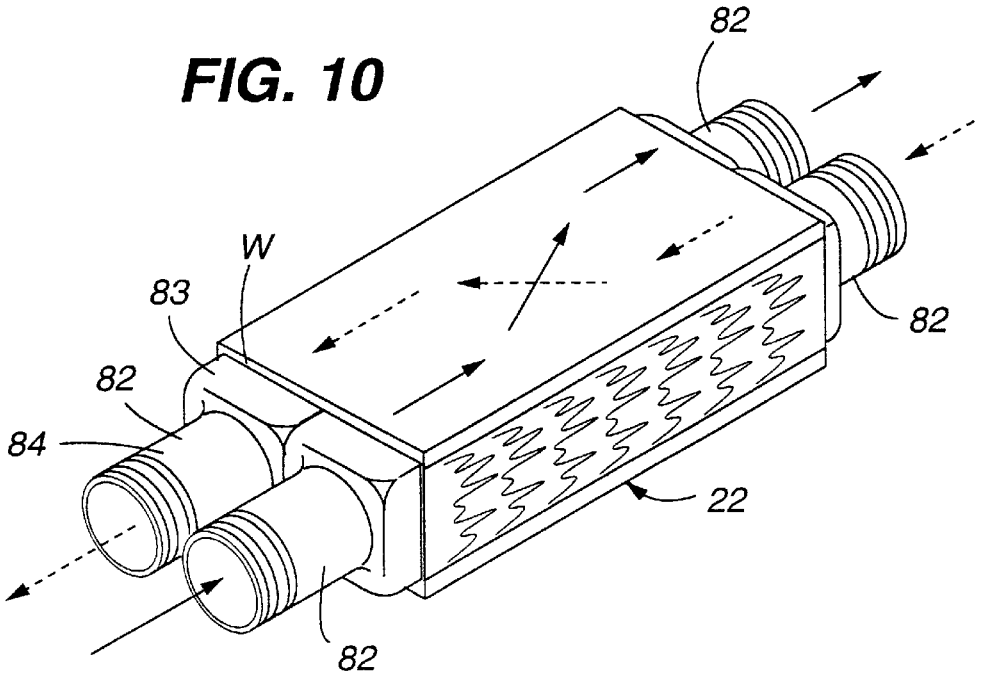
FIG. 10 is a perspective view of another heat exchanger device with the same core and four straight on end caps.
Figure 1:
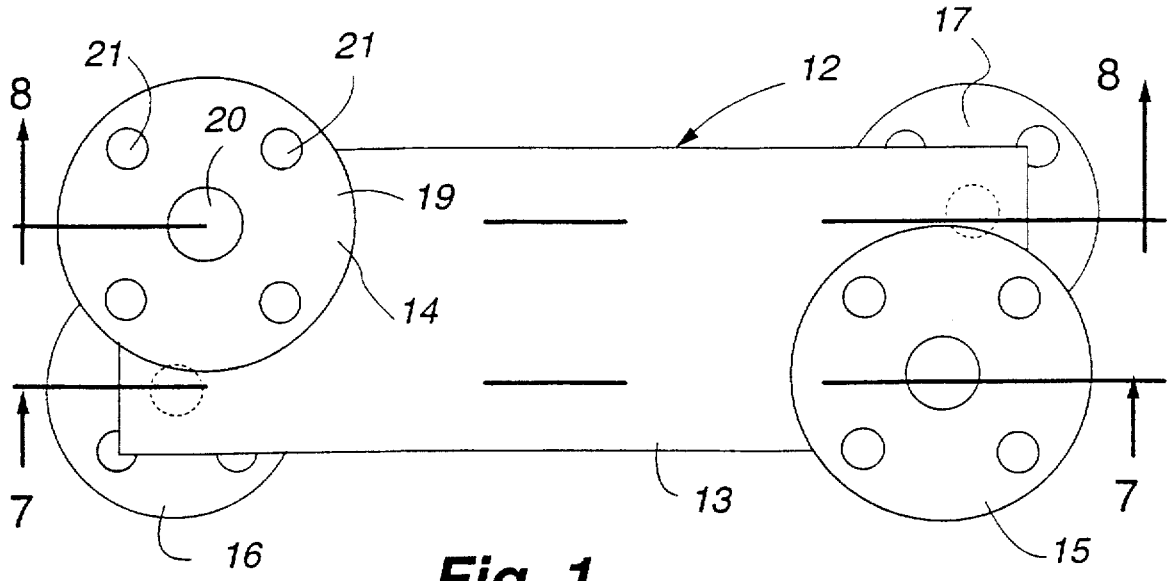
Figure 2:
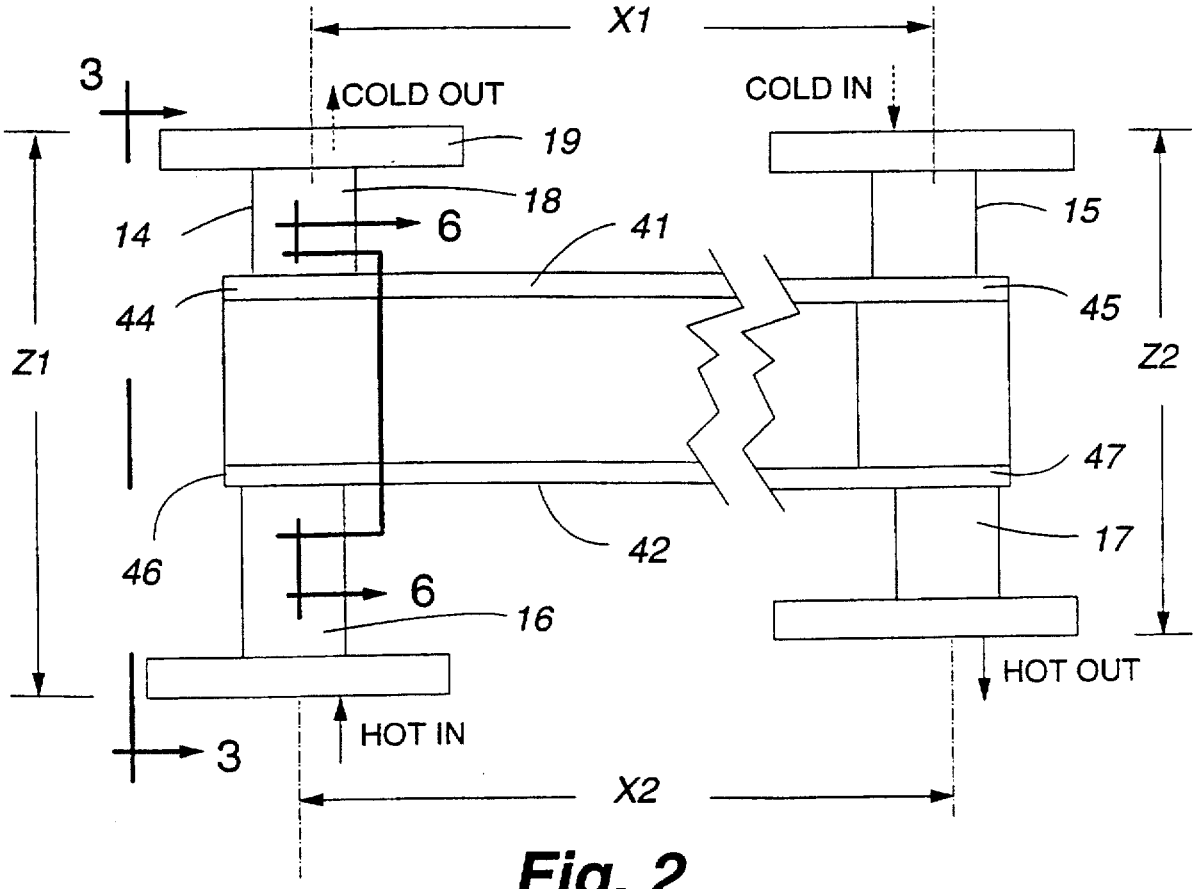
Figure 3:
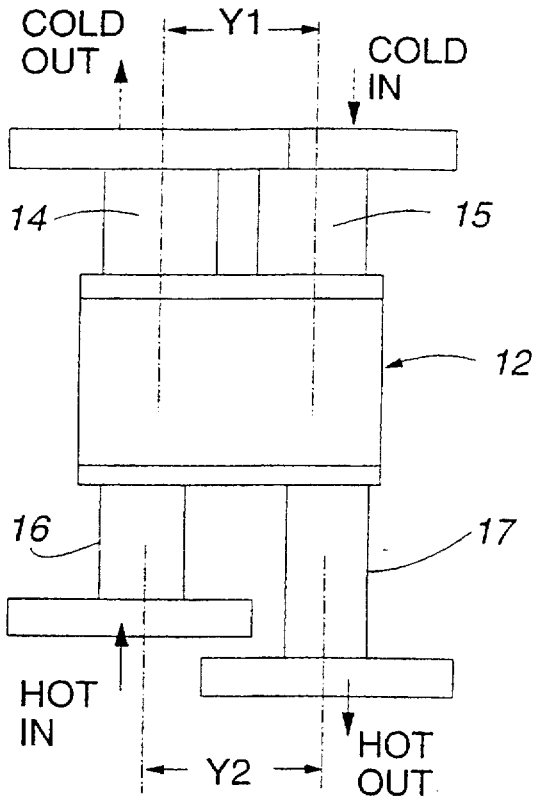
Figure 4:
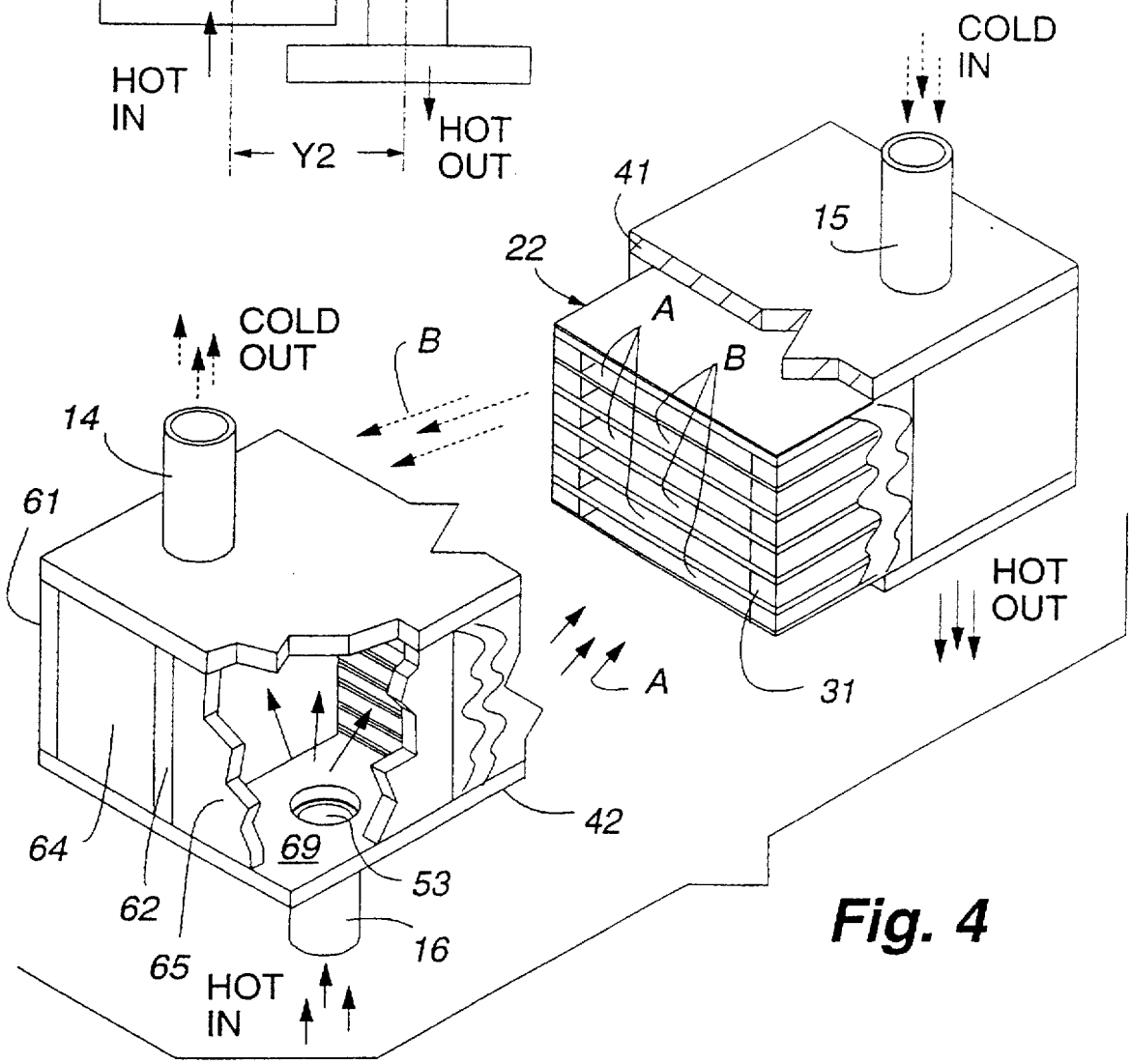
Figure 5:
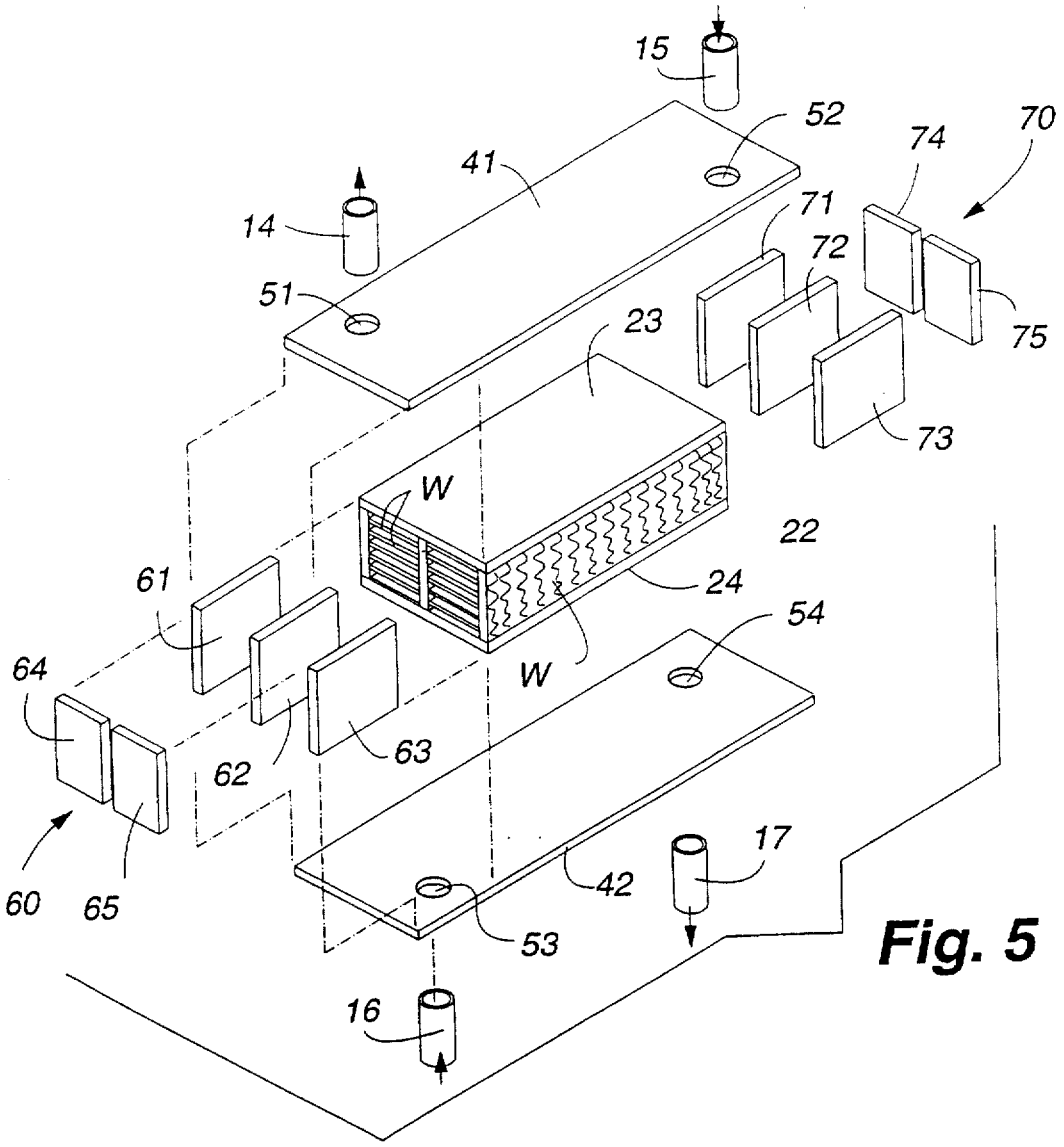
Figure 6A:
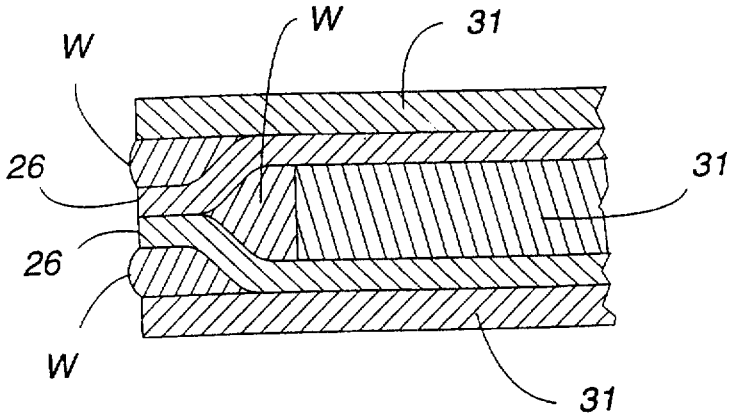
Figure 6:
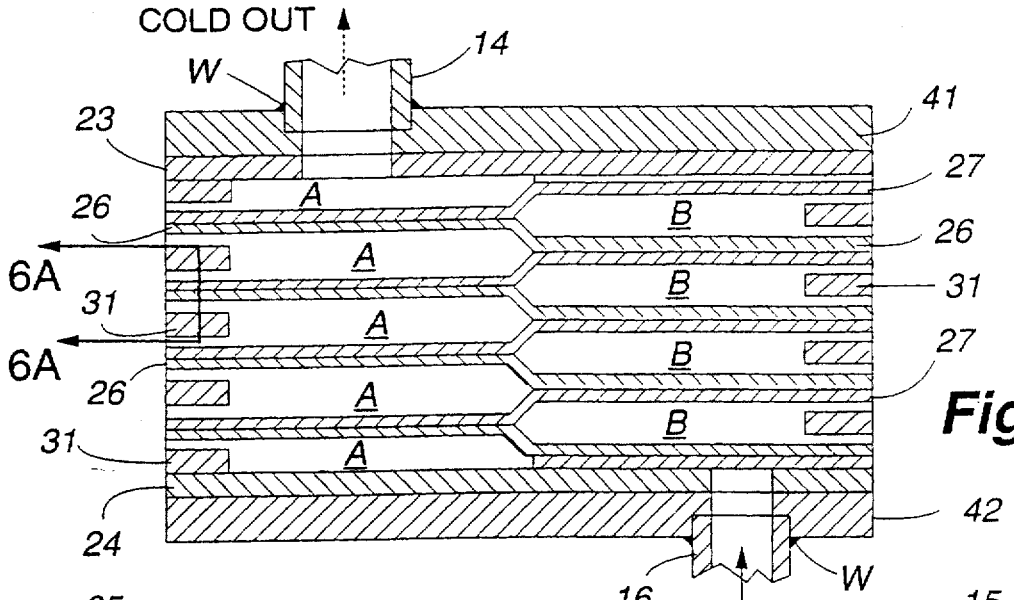
Figure 7:
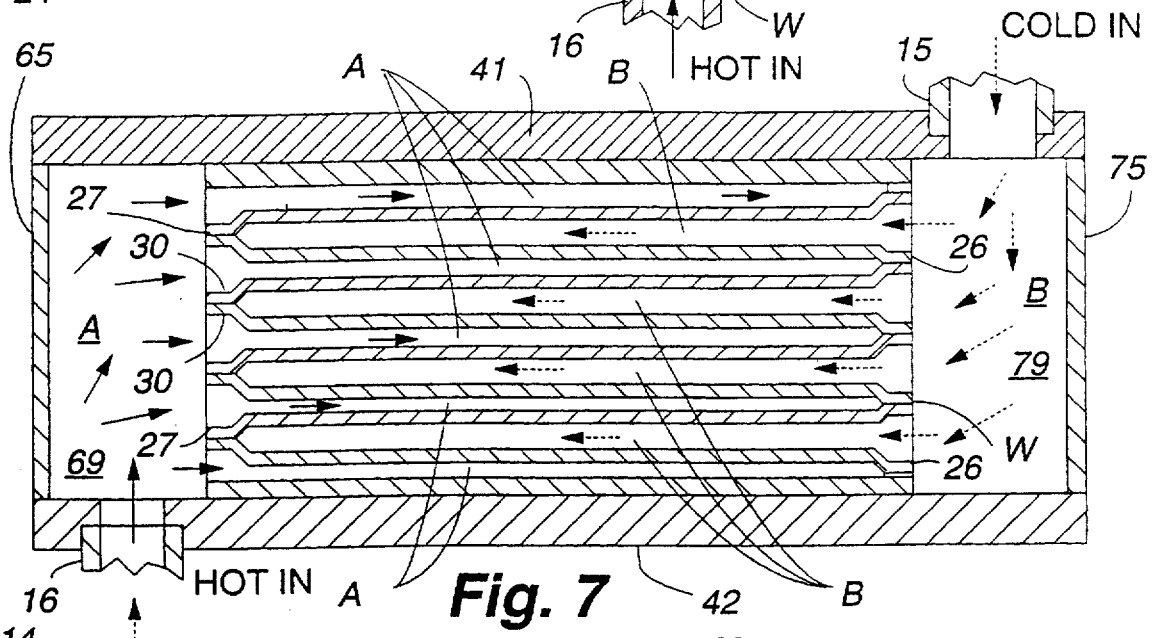
Figure 8:
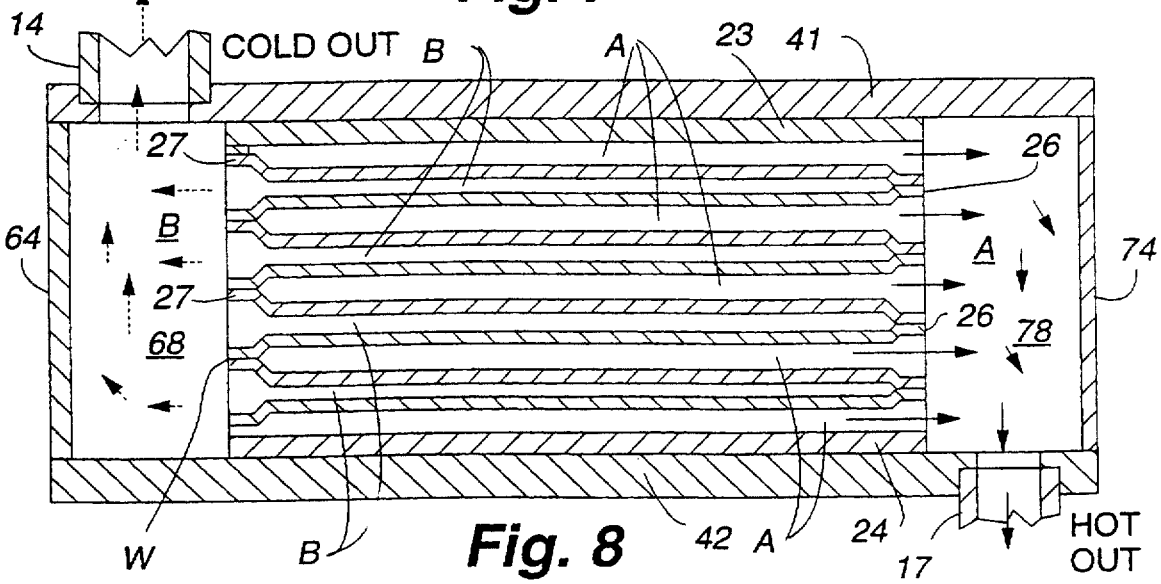
Figure 9:
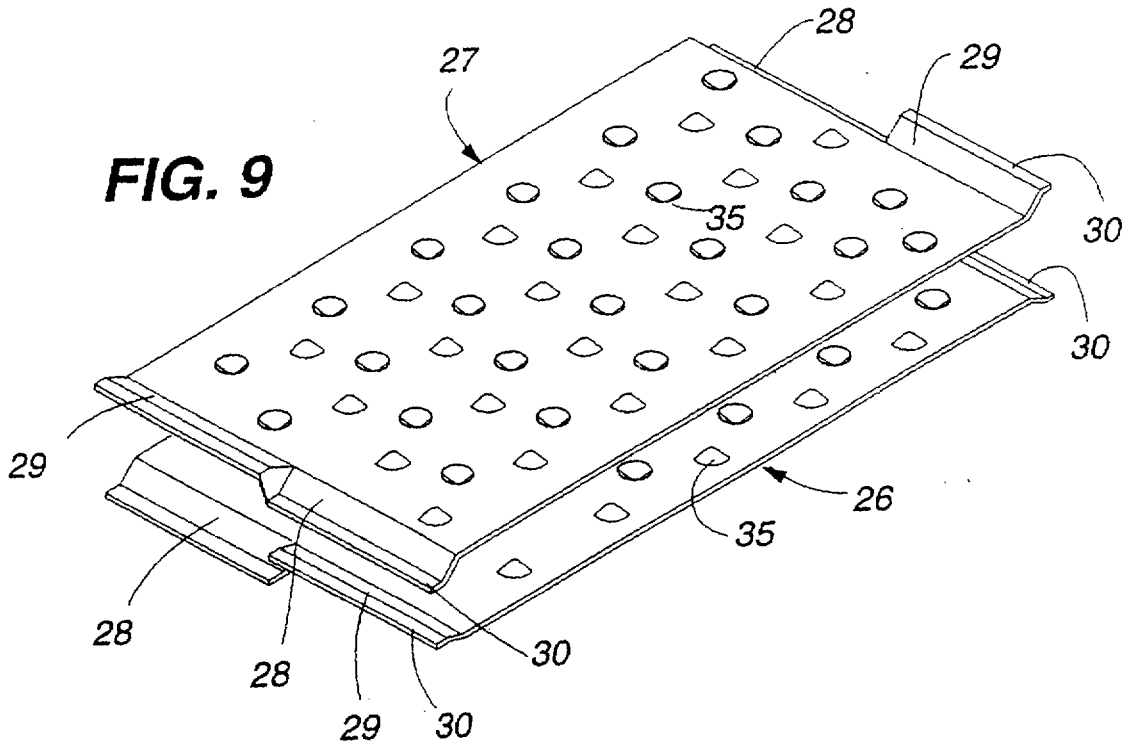
Figure 10:
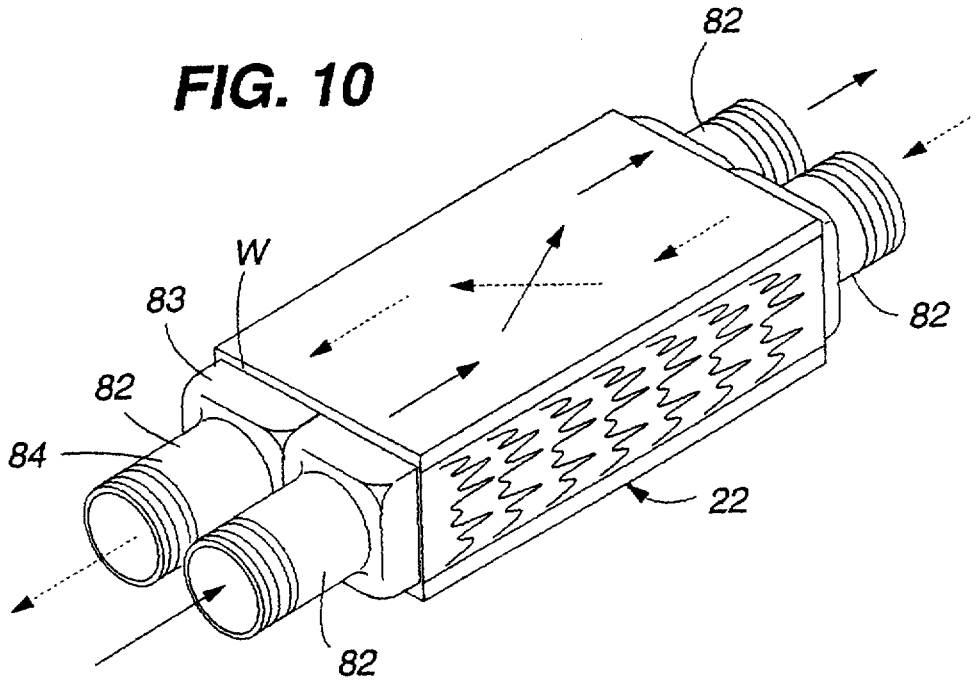

Referring now to FIG. 10 there is shown a core 22 having four identical straight on end flow connectors or caps 82 connected to the opposite ends of the core 22 to pass the hot and cold fluids straight on or longitudinally from the ends in a linear flow. These end flow connectors or caps 82 have a hollow rectangular base section 83 with two side by side corresponding with the size of the end of the core and a tubular section 84 with external threads for line connecting purposes. With this embodiment the core can be tested prior to installing the end connectors.

Although the present invention has been described with a certain degree of particularity, it is understood that the present disclosure has been made by way of example and that changes in details of structure may be made without departing from the spirit thereof.

What is claimed is:

1. A heat exchanger device comprising:

a separately constructed, leak tested heat exchanger core having flat opposed first and second outer core plates, a stack of parallel spaced inner core plates between said first and second outer core plates, said outer core plates being constructed of a thickness or material having a greater ability to resist pressure than said inner core plates with spaces between said inner core plates defining alternate flow passages for hot and cold fluids, said outer core plates extending parallel to said inner core plates, an attachable first core retaining plate affixed to one face of said core and extending parallel to said first outer core plate having opposed first and second end portions extending beyond the ends of said core and having a first pair of flow apertures at preselected precise positions in relation to flow line connectors to which the device is connected, an attachable second core retaining plate affixed to an opposite face of said core and extending parallel to said second outer core plate having opposed first and second end portions extending beyond the ends of said core with a second pair of apertures at preselected precise positions in relation to flow line connectors to which the device is connected for fluid flow, attachable first end wall portions connected to said first and second core retaining plates at one end of said core forming first flow compartments to pass fluid toward and away from said core and through one each of said first and second pairs of apertures, and attachable second end wall portions connected to said top and bottom core retaining plates at an opposite end of said core forming second flow compartments to pass fluid toward and away from said core and through one each of said other of said first and second pairs of apertures.

2. A device as set forth in claim 1 wherein said device has selected dimensions between the center lines of said apertures of each of said core retaining plates longitudinally of said core and selected dimensions between the center lines of said apertures of said core retaining plates laterally of said core.

3. A device as set forth in claim 1 including a flow connector connected to each of said apertures and extending transverse to an associated core retaining plate.

4. A device as set forth in claim 3 wherein each of said flow connectors includes a tubular portion fastened to an associated core retaining plate and a flange portion having apertures for fastening to flow line connectors to which the device is connected.

5. A device as set forth in claim 3 wherein said flow connector extends into an associated of said apertures and is welded thereto.

6. A device as set forth in claim 1 wherein each of said inner core plates is in the form of a thin flat rectangular heat-conductive sheet having a downwardly inclined end section along about one half the width of said inner core plate and an upwardly inclined end section along about the other one half the width of said inner core plate at one end together with an upwardly inclined end section along about one half the width of said inner core plate and a downwardly inclined end section along about one half the width of said plate at the other end of said inner core plate, said inner core plates having alternating upwardly inclined sections and downwardly inclined sections such that each said downwardly inclined section on one said inner core plate fits against an upwardly inclined section of a next lower inner core plate to form diagonally extending flow passages between said inner core plates.

7. A device as set forth in claim 6 wherein opposite of said end sections have flat terminal sections that butt against one another to form an end closure along about one half the width and a flow opening along about the other half the width of successive layers of said plates.

8. A device as set forth in claim 7 including a pair of longitudinal edge spacers disposed between and extending along the edges of said inner plates to separate said inner plates.

9. A device as set forth in claim 8 wherein alternate of said edge spacers are staggered at the ends to extend the full length of said plates and to fit between said inclined end sections that are closed by said flat terminal sections.

10. A device as set forth in claim 7 wherein said butting terminal sections are welded together.

11. A device as set forth in claim 1 wherein each of said inner plates has a preselected pattern of indentations that provide strength, spacing between plates and agitation to fluid flow.

12. A device as set forth in claim 1 wherein said first and second outer core plates and said stack of inner core plates are welded together to form an all welded heat exchanger core, and said first and second core retaining plates and said first and second end wall portions are welded together with said core to form an all welded heat exchanger.

* * * * *

UNITED STATES PATENT AND TRADEMARK OFFICE

CERTIFICATE OF CORRECTION

PATENT NO. : 5,823,247
DATED : October 20, 1998
INVENTOR(S) : Walter W. Weibler

It is certified that error appears in the above-identified patent and that said Letters Patent is hereby corrected as shown below:

The title page, showing the illustrative figure should be deleted to be replaced with the attached title page.

Drawing sheets, consisting of Figs. 1-5, should be deleted to be replaced with the Drawing Sheets, consisting of Figs. 1-5, as shown on the attached page.

Signed and Sealed this

Twenty-seventh Day of July, 1999

*Attest:*

Q. TODD DICKINSON

*Attesting Officer*

*Acting Commissioner of Patents and Trademarks*

United States Patent [19]

Weibler

[11] Patent Number: 5,823,247

[45] Date of Patent: Oct. 20, 1998

[54] HEAT EXCHANGER AND METHOD

[76] Inventor: Walter W. Weibler, 7652 Webster Way, Arvada, Colo. 80003

[21] Appl. No.: 689,708

[22] Filed: Aug. 16, 1996

[51] Int. Cl.[6] ..... F28D 9/02

[52] U.S. Cl. ..... 165/76; 165/166; 165/DIG. 384; 228/183

[58] Field of Search ..... 165/165, 166, 165/76; 228/183

[56] References Cited

U.S. PATENT DOCUMENTS

| | | | |
|---|---|---|---|
| 1,548,159 | 8/1925 | Murray | 165/166 |
| 2,596,008 | 5/1952 | Collins | 165/166 X |
| 2,959,400 | 11/1960 | Simpelaar . | |
| 3,229,763 | 1/1966 | Rosenblad | 165/166 |
| 4,569,391 | 2/1986 | Hulswitt et al. | 165/166 |
| 4,688,631 | 8/1987 | Peze et al. | 165/166 |
| 5,069,276 | 12/1991 | Seidel | 165/166 |
| 5,303,771 | 4/1994 | Des Champs | 165/165 |
| 5,469,914 | 11/1995 | Davison et al. . | |

FOREIGN PATENT DOCUMENTS

| | | | |
|---|---|---|---|
| 1183834 | of 0000 | Canada . | |
| 0040890 | of 0000 | European Pat. Off. . | |
| 1389833 | 1/1965 | France | 165/166 |

*Primary Examiner*—Allen Flanigan

*Attorney, Agent, or Firm*—Ancel W. Lewis, Jr.

[57] ABSTRACT

A heat exchanger device and method of making same disclosed has a heat exchanger core and a stack of inner plates with alternating hot and cold flow fluid passages producing diagonal flow therethrough. One embodiment adds a pair of core retaining plates with end portions extending beyond the core with apertures at precise locations to connect with connectors of equipment to which it is coupled and the other embodiment has end connectors that weld to the core to provide straight in line fluid flow.

12 Claims, 5 Drawing Sheets

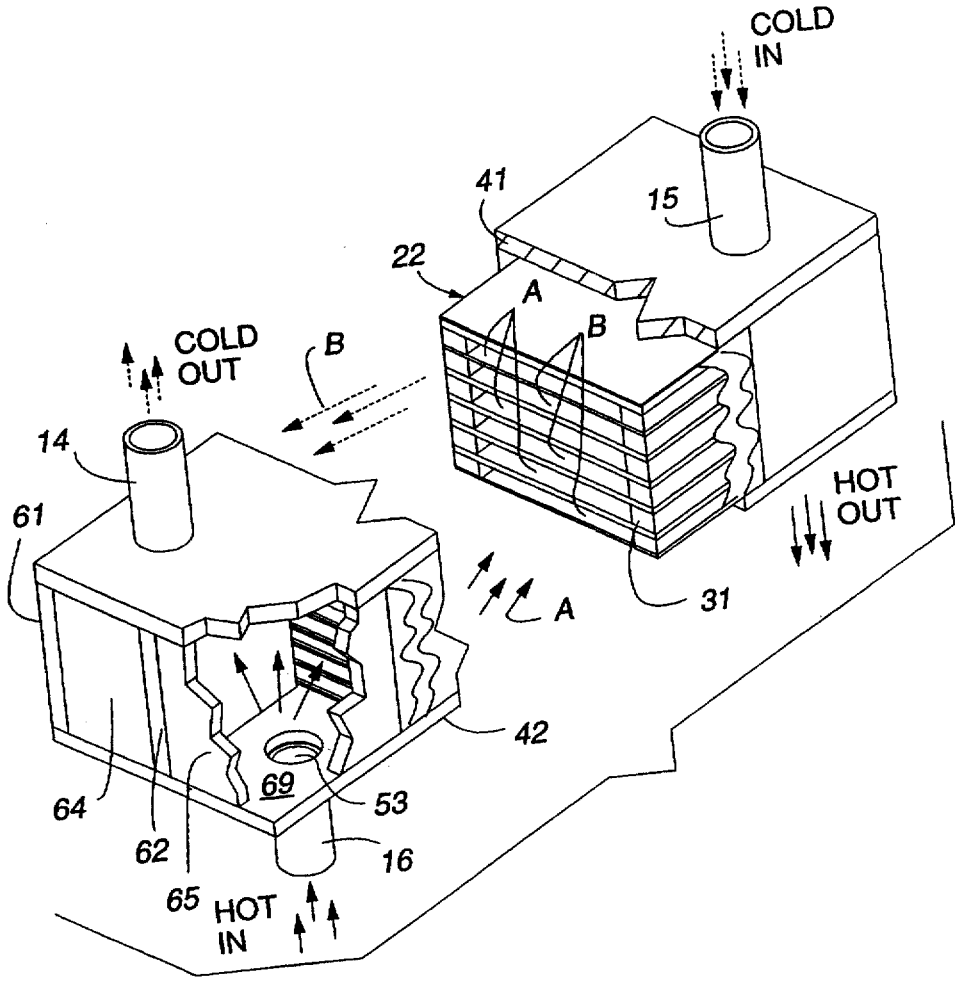

US005823247C1

(12) EX PARTE REEXAMINATION CERTIFICATE (5345th)

United States Patent
Weibler

(10) Number: US 5,823,247 C1
(45) Certificate Issued: Apr. 18, 2006

(54) HEAT EXCHANGER AND METHOD

(75) Inventor: Walter W. Weibler, 7652 Webster Way, Arvada, CO (US) 80003

(73) Assignee: Walter W. Weibler, Arvada, CO (US)

Reexamination Request:
No. 90/006,429, Oct. 30, 2002

Reexamination Certificate for:

| | |
|---|---|
| Patent No.: | **5,823,247** |
| Issued: | **Oct. 20, 1998** |
| Appl. No.: | **08/689,708** |
| Filed: | **Aug. 16, 1996** |

Certificate of Correction issued Jul. 27, 1999.

(51) Int. Cl.
*F28D 9/02* (2006.01)

(52) U.S. Cl. ..... 165/76; 165/166; 165/DIG. 384; 228/183

(58) Field of Classification Search ..... 165/165, 165/166, 167, 76, DIG. 384; 228/183
See application file for complete search history.

(56) References Cited

U.S. PATENT DOCUMENTS

| | | | |
|---|---|---|---|
| 1,737,564 A | 12/1929 | Braun | |
| 1,842,945 A | 1/1932 | Price et al. | |
| 3,540,531 A | 11/1970 | Becker | |
| 3,568,765 A | 3/1971 | Konrad | |
| 5,487,424 A | 1/1996 | Davison | |

FOREIGN PATENT DOCUMENTS

| | | | |
|---|---|---|---|
| AT | 223634 | * 10/1962 | ..... 165/166 |
| GB | 2033570 | * 5/1980 | ..... 165/166 |

OTHER PUBLICATIONS

Webster's II New Riverside Dictionary, 83, 136 (The Riverside Publishing Company, 1984 ed.).
Standard Test Method for Leaks Using Bubble Emission Techniques, ASTM E515–94 (Published May 1994).
Standard Guide for Selection of a Leak Testing Method, ASTM E432–91 (Published Jun. 1991).

* cited by examiner

*Primary Examiner*—Steven J. Ganey

(57) ABSTRACT

A heat exchanger device and method of making same disclosed has a heat exchanger core and a stack of inner plates with alternating hot and cold flow fluid passages producing diagonal flow therethrough. One embodiment adds a pair of core retaining plates with end portions extending beyond the core with apertures at precise locations to connect with connectors of equipment to which it is coupled and the other embodiment has end connectors that weld to the core to provide straight in line fluid flow.

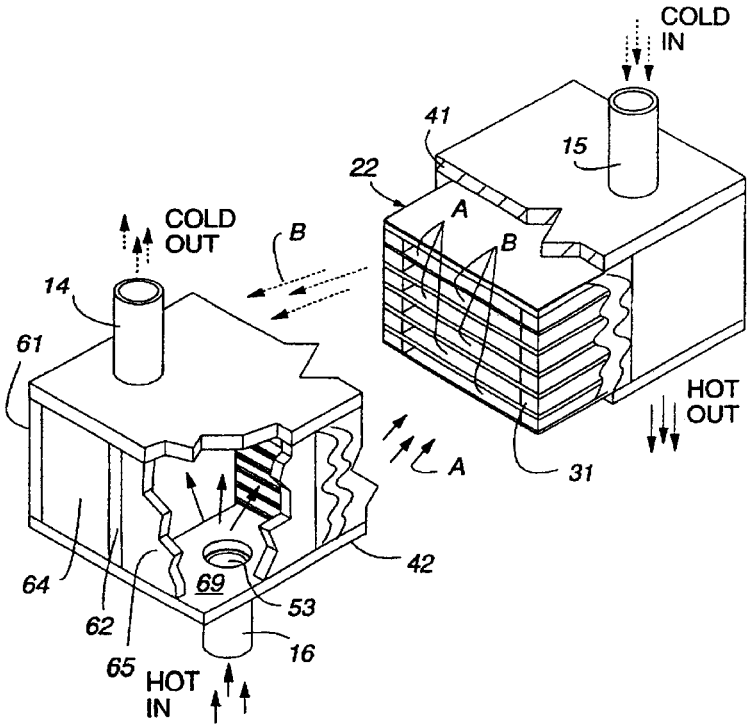

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *